US010040177B2

(12) United States Patent
Liu

(10) Patent No.: US 10,040,177 B2
(45) **Date of Patent: *Aug. 7, 2018**

(54) SOCKET WRENCH

(71) Applicant: Yi-Fu Chen, Taichung (TW)

(72) Inventor: Shih-Chieh Liu, Taichung (TW)

(73) Assignee: Yi-Fu Chen, Taichung (TW)

( * ) Notice: Subject to any disclaimer, the term of this patent is extended or adjusted under 35 U.S.C. 154(b) by 206 days.

This patent is subject to a terminal disclaimer.

(21) Appl. No.: 15/222,963

(22) Filed: Jul. 29, 2016

(65) Prior Publication Data

US 2016/0332283 A1 Nov. 17, 2016

Related U.S. Application Data

(63) Continuation-in-part of application No. 14/219,004, filed on Mar. 19, 2014, now Pat. No. 9,498,869.

(51) Int. Cl.

| | |
|---|---|
| ***B25B 13/46*** | (2006.01) |
| ***B25B 13/06*** | (2006.01) |
| ***B25B 23/00*** | (2006.01) |

(52) U.S. Cl.

CPC ..... *B25B 13/46* (2013.01); *B25B 13/06* (2013.01); *B25B 13/461* (2013.01); *B25B 13/463* (2013.01); *B25B 23/0035* (2013.01)

(58) Field of Classification Search

CPC ..... B25B 13/46; B25B 13/06; B25B 13/461; B25B 13/463; B25B 23/0035

See application file for complete search history.

(56) References Cited

U.S. PATENT DOCUMENTS 9,498,869 B2 * 11/2016 Liu ..... B25B 13/463
2014/0182421 A1 * 7/2014 Chang ..... B25B 23/0035 81/124.3

* cited by examiner

*Primary Examiner* — David B Thomas
(74) *Attorney, Agent, or Firm* — Rosenberg, Klein & Lee

(57) ABSTRACT

A socket wrench includes a wrench body, a ratchet wheel and a positioning ring. The ratchet wheel has a driving hole and a cylindrical flange extending on one side of the wrench body. The cylindrical flange has at least one aperture defined through the outer periphery thereof and communicating with the driving hole. The positioning ring is an O-shaped ring and surrounded the outer periphery of the cylindrical flange, and has a central bore. At least one protrusion radially protruded from the inner wall of the central bore of the positioning ring. The protrusion is projected from the wall of the driving hole through the aperture to position a socket. The positioning ring is moved a distance along the radial direction relative to the ratchet wheel by being pushed toward the at least one protrusion to completely retract the at least one protrusion into the aperture to release the socket.

12 Claims, 18 Drawing Sheets

SOCKET WRENCH

FIELD OF THE INVENTION

The present invention is a Continuation-In-Part application of applicant's former patent application Ser. No. 14/219,004, filed on Mar. 19, 2014.

BACKGROUND OF THE INVENTION

Description of Related Art

As shown in FIGS. 1-2, a conventional socket wrench 10 comprises a ratchet wheel 11 disposed in a head of the socket wrench 10. The ratchet wheel 11 has a polygonal driving hole 111 defined therethrough. The ratchet wheel 11 has a groove 112 annularly defined in an inner periphery of the driving hole 111 for accumulating a resilient C-ring 12. A socket 20 defines a post 201 with polygonal shape at one end and a plurality of notches 202 spaced in an outer periphery of the post 201. Therefore, the socket 20 can be positioned in the driving hole 111 by the C-ring 12 clipping the notches 202 of the socket 20 so as to prevent the socket 20 from being detached from the socket wrench 10.

There are still some shortcomings of the conventional socket wrench 10. Such as the C-ring may be resiliently expanded while the socket 20 is operated so that the socket 20 cannot be secured in the driving hole 111 of the ratchet wheel 11 steadily. Besides, elastic fatigue of the C-ring may be occurred during a long-term utilization.

U.S. Pat. No. 7,082,861 to Chen discloses a wrench with a substantially C-shaped latch ring surrounding the external periphery of the ratchet. One end of the latch ring is bent into a latch end which is passed into the latch hole of the ratchet, and the other end of the latch ring is bent into a latch surface which is latched into the latch groove.

The latch surface protruded slightly from the polygonal groove, and the latch end is latched into the latch hole of the ratchet. The latch ring is restricted by the latch hole of the ratchet and the latch groove so that the latch ring does not fall from the ratchet, The latch surface and the latch end provide two different contacts with the nut in the ratchet.

In order not to let the latch ring drop from the ratchet, the ratchet has a latch groove defined in the outer periphery thereof so that the latch surface is engaged with the latch groove of the ratchet to achieve the above mentioned feature. The latch ring cannot be moved radially a distance relative to the ratchet because the latch surface and the latch end are both secured to the ratchet.

U.S. Pat. No. 6,481,315 to Chang et al. discloses a box end wrench having a retainer ring of resilient metal mounted in the outside annular groove of the ratchet wheel. The retainer ring has a plurality of protruded retaining portions inserted through respective radially extended through hole of the ratchet wheel and adapted to hold down the workpiece in the serrated center coupling hole of the ratchet wheel.

The retaining ring is hidden within the head of the wrench and cannot be operated by the user. Again, the retaining ring cannot move radially a distance relative to the ratchet wheel, the retaining ring can only be passively expanded by squeezing an object into the hole of the ratchet wheel. It is also noted that the retaining ring is engaged with the locating groove of the protruded portion of the ratchet wheel, so that the retaining ring is not supposed to move a distance in the radial direction relative to the ratchet wheel.

The present invention provides an O-shaped positioning ring which is movably surrounded to the ratchet wheel. The positioning ring is pushed in the radial direction relative to the ratchet wheel to remove the protrusion away from the ratchet wheel to allow the workpiece to be easily removed from the ratchet wheel.

SUMMARY OF THE INVENTION

The main objective of the present invention is to provide an improved socket wrench.

To achieve the objective, a socket wrench comprises a wrench body, a ratchet wheel and a positioning ring. The ratchet wheel is received in the wrench body. The ratchet wheel has a driving hole and a cylindrical flange extending on one side of the wrench body.

The cylindrical flange of the ratchet wheel has an outer periphery thereof, and at least one aperture is defined through the cylindrical flange and communicates with the driving hole. A positioning ring is an O-shaped ring and movably surrounded the outer periphery of the cylindrical flange of the ratchet wheel. The positioning ring has a central bore and at least one protrusion extends radially from the inner wall of the central bore of the positioning ring. The at least one protrusion is projected into the driving hole through the aperture of the ratchet wheel so as to position a socket. The positioning ring is moved a distance along the radial direction relative to the ratchet wheel by being pushed toward the at least one protrusion to completely retract the at least one protrusion into the aperture to release the socket.

Specifically, the driving hole of the ratchet wheel has a plurality of inner corners. The aperture of the ratchet wheel is defined in one of the inner corners of the driving hole of the ratchet wheel. The socket wrench further comprises a C-ring. The cylindrical flange of the ratchet wheel has an annular groove in the outer periphery thereof. The C-ring is positioned in the retaining groove to prevent the positioning ring from dropping from the cylindrical flange.

Furthermore, the positioning ring has an elastic member disposed on the inner wall of the central bore of the positioning ring opposite to the protrusion. The elastic member is sandwiched in between the outer periphery of the cylindrical flange of the ratchet wheel and the inner wall of the central bore of the positioning ring. Wherein, the positioning ring has a recess in the inner wall of the central bore opposite to the protrusion for accommodating the elastic member. More specifically, the protrusion is detachable from the inner wall of the central bore of the positioning ring. The positioning ring has a receiving groove in the inner wall of the central bore of the positioning ring for partially accommodating the protrusion.

Further benefits and advantages of the present invention will become apparent after a careful reading of the detailed description with appropriate reference to the accompanying drawings.

DETAILED DESCRIPTION OF THE INVENTION

Figure 1:
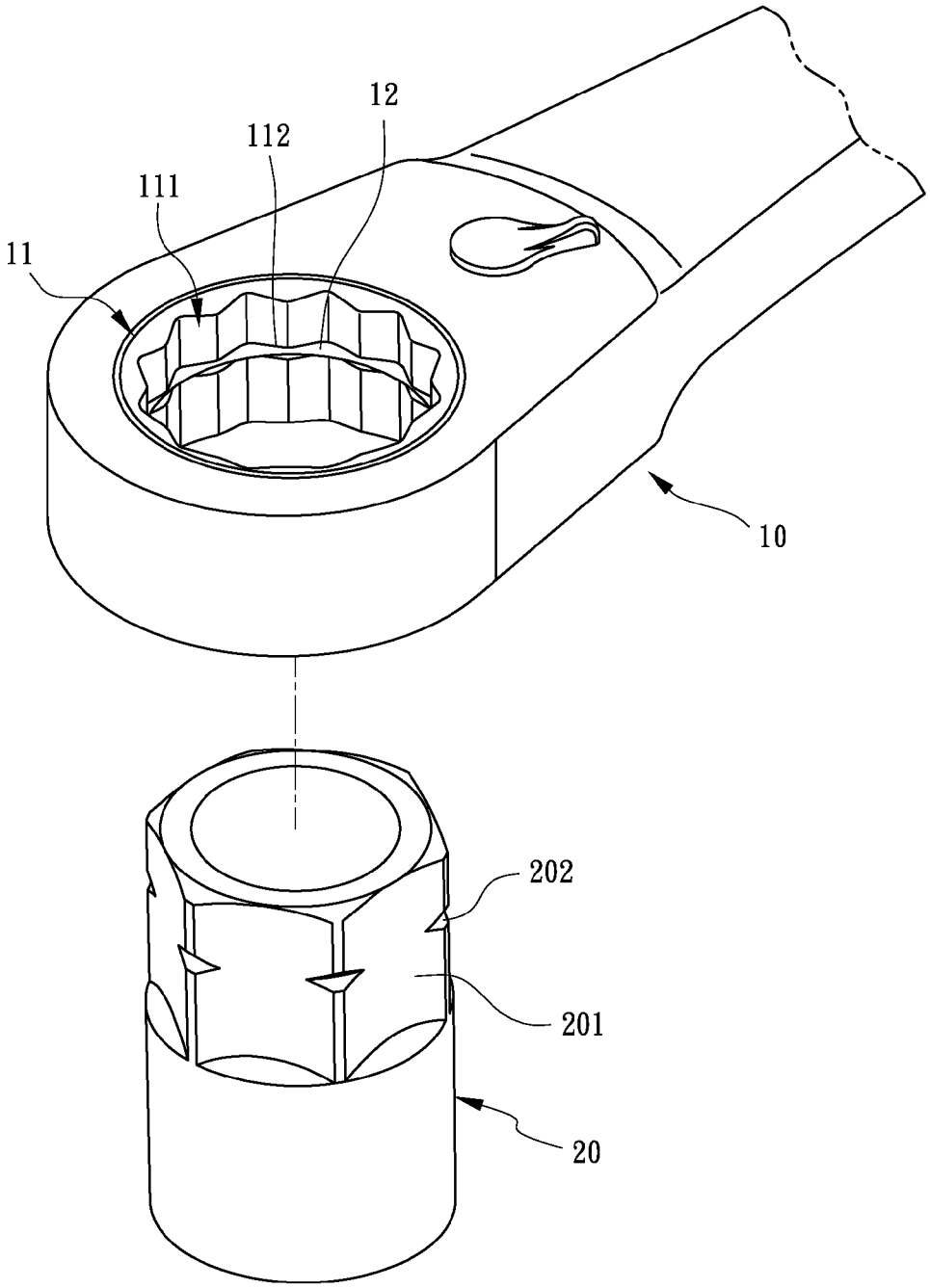
FIG.1 (Prior art)
FIGS. 1-2 are prior art.
Figure 2:
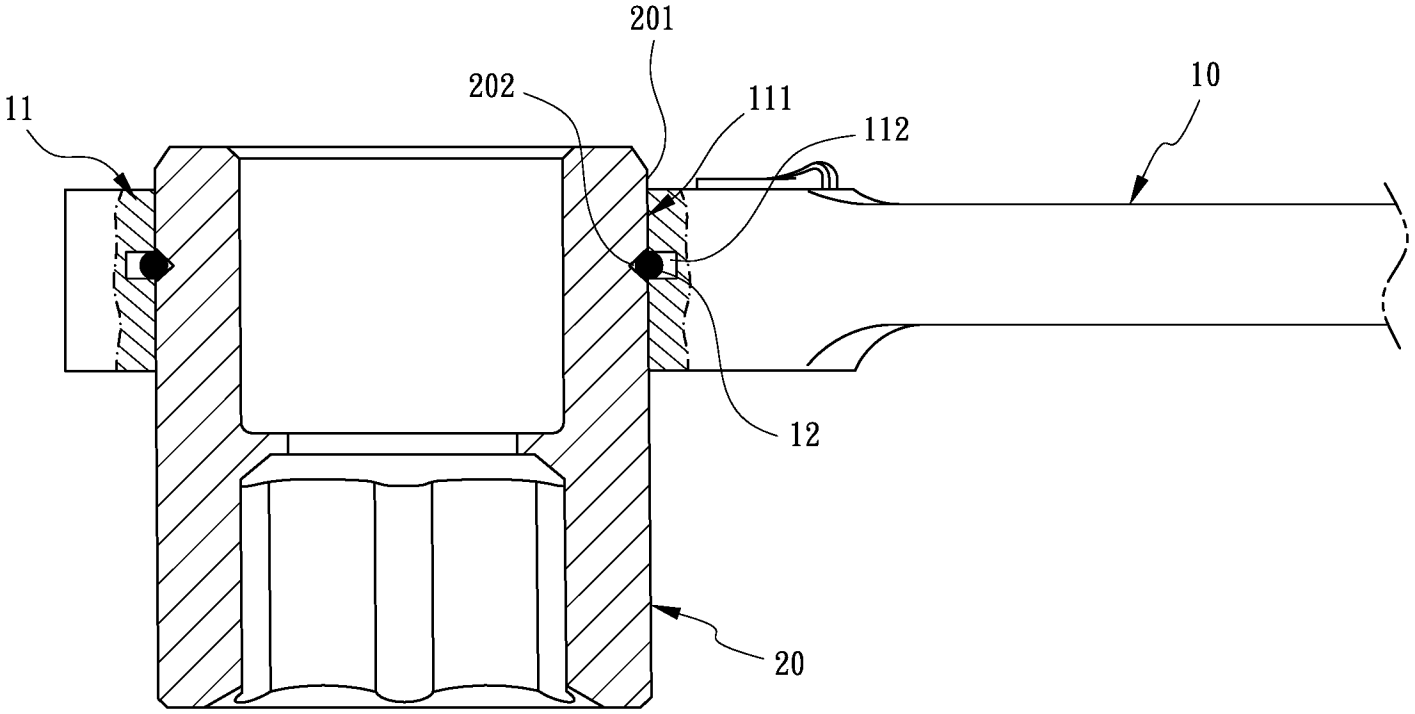
FIG.2 (Prior art)
Figure 3:
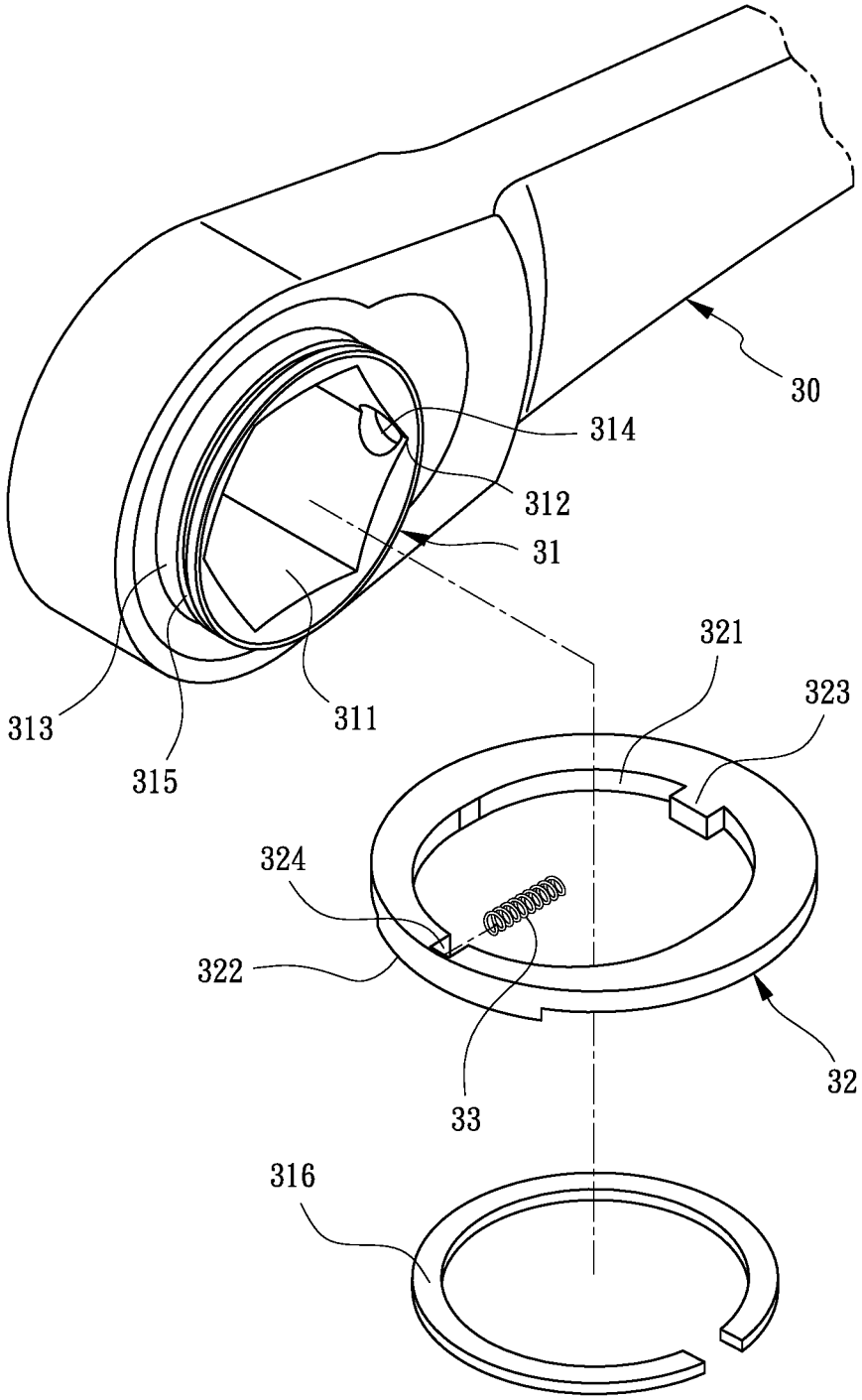
FIG. 3 is a partial exploded perspective view of a socket wrench in accordance with a first embodiment of the present invention.
Figure 4:
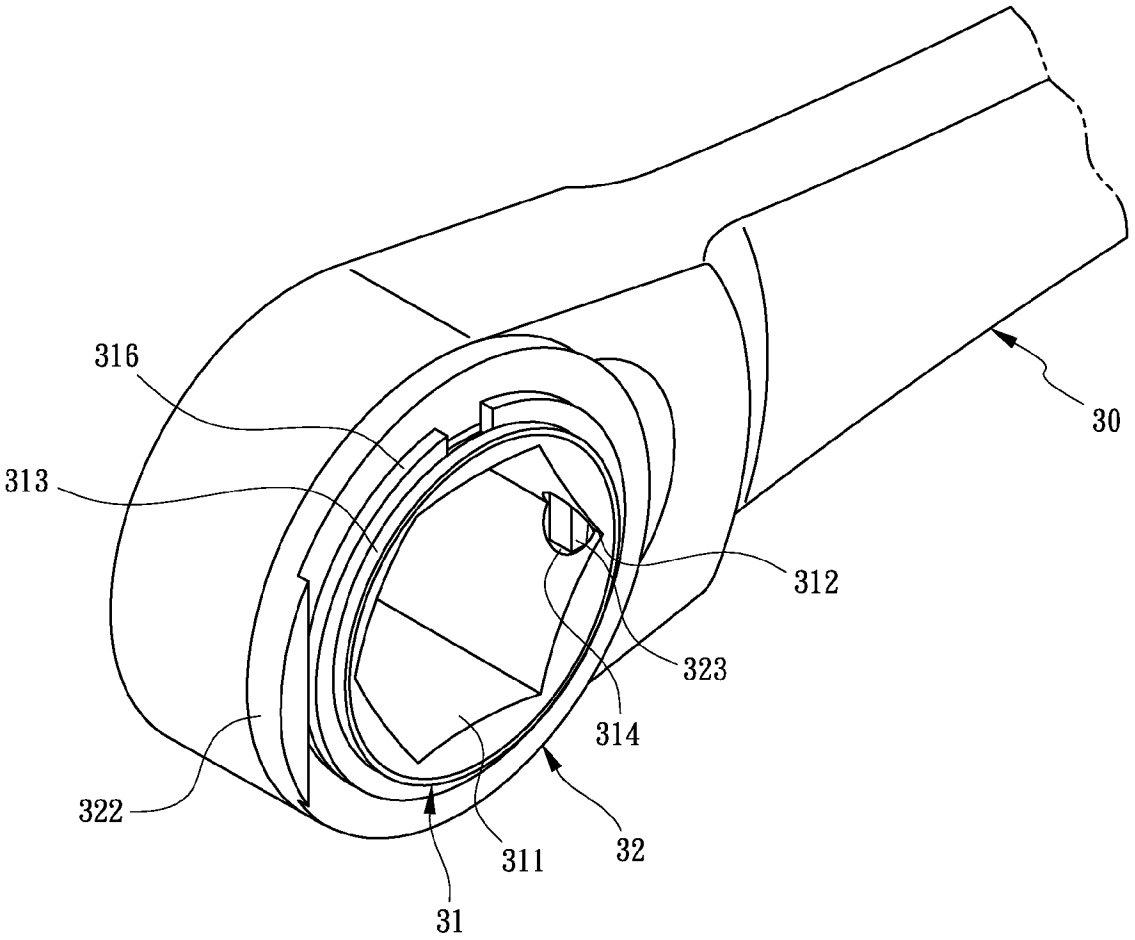
FIG. 4 is a perspective view of the socket wrench shown in FIG. 1.
Figure 5:
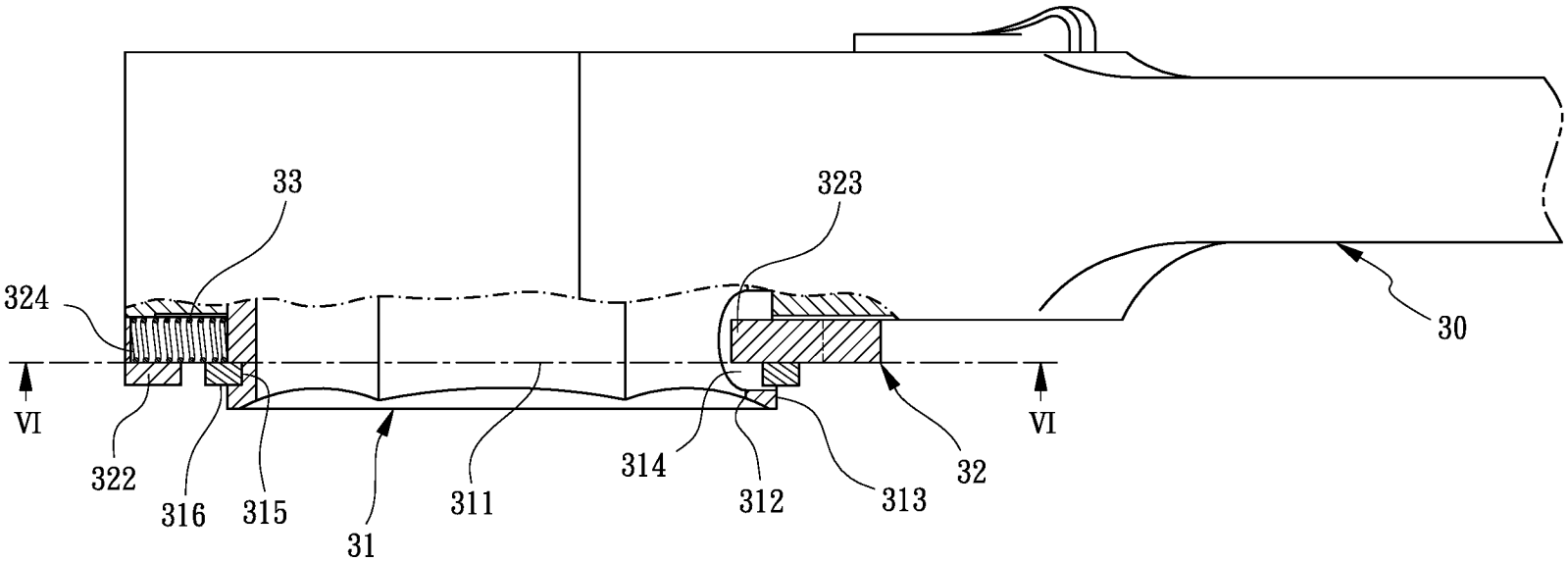
FIG. 5 is a partial cross-sectional view of the socket wrench shown in FIG. 4.
Figure 6:
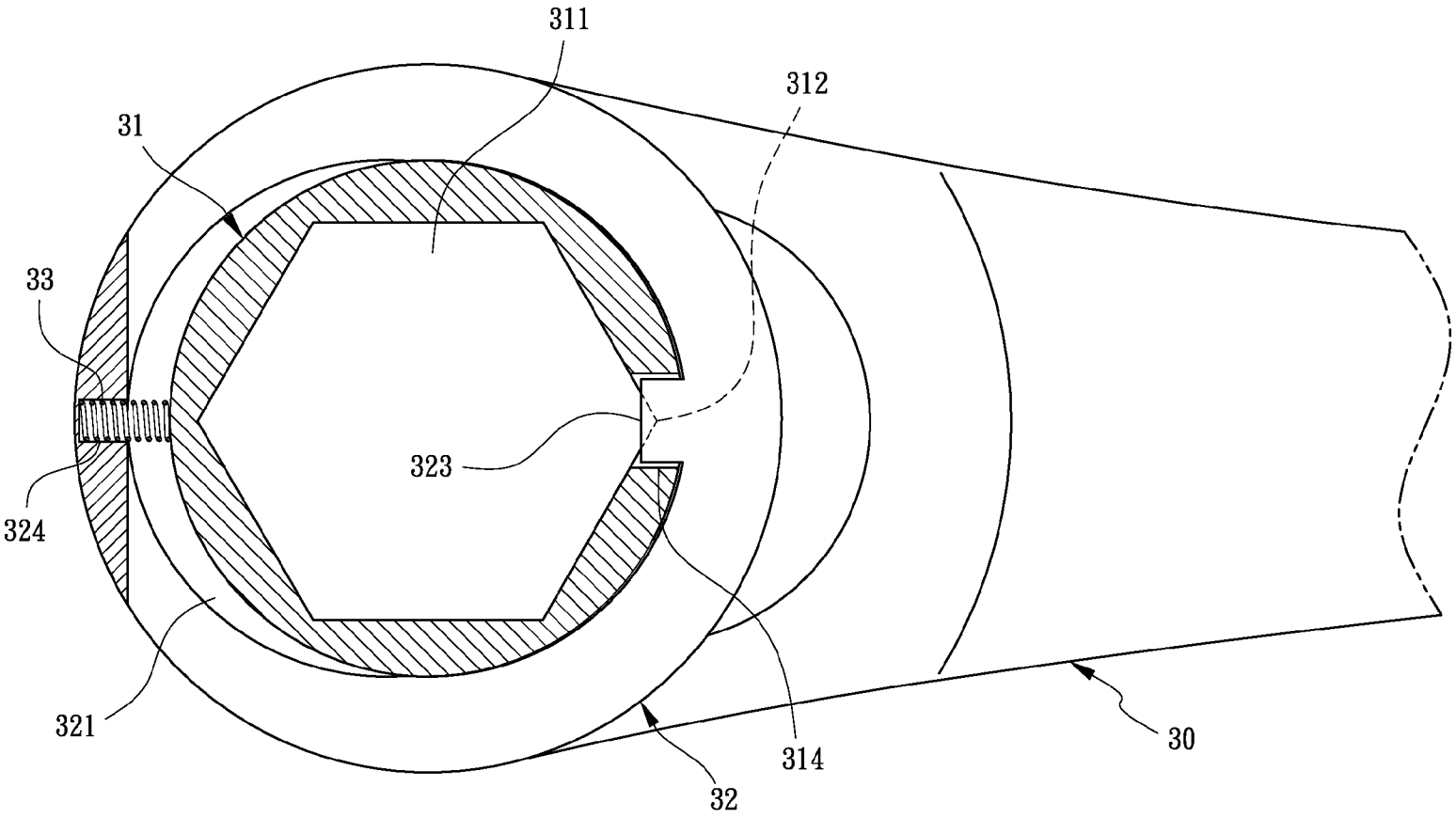
FIG. 6 is a cross-sectional view of the socket wrench along line VI-VI of FIG. 5.

Referring to FIGS. 3-6, a socket wrench in accordance with a first embodiment of the present invention comprises a wrench body 30, a ratchet wheel 31 and a positioning ring 32. The ratchet wheel 31 is received in the wrench body 30. The ratchet wheel 31 has a driving hole 311 and a cylindrical flange 313 extending from one side of the wrench body 30. The cylindrical flange 313 of the ratchet wheel 31 has an aperture 314 defined through the outer periphery thereof, and the aperture 314 communicates with the driving hole 311 of the ratchet wheel 31. The positioning ring 32 is movably surrounded the cylindrical flange 313 of the ratchet wheel 31. Specifically, the positioning ring 32 has a central bore 321 and a protrusion 323 radially protrudes from the inner wall of the central bore 321 of the positioning ring 32. As shown in FIGS. 4-6, the protrusion 323 is projected from the wall of the driving hole 311 through the aperture 314 of the ratchet wheel 31. The positioning ring 32 is moved a distance along the radial direction relative to the ratchet wheel 31 by being pushed toward the at least one protrusion 323 to completely retract the at least one protrusion 323 into the aperture 314.

In the first embodiment of the present invention, the driving hole 311 of the ratchet wheel 31 is hexagonal and defines a plurality of inner corners 312, as shown in FIG. 4. The aperture 314 of the ratchet wheel 31 is defined in one of the inner corners 312 of the driving hole 311 of the ratchet wheel 31 so that the protrusion 323 can be projected from the respective corner 312. Referring to FIGS. 3-4, the socket wrench of the first embodiment further comprises a C-ring 316. Furthermore, the cylindrical flange 313 of the ratchet wheel 31 has an annular groove 315 in the outer periphery thereof. The C-ring 316 is positioned in the retaining groove 315 to prevent the positioning ring 32 from dropping from the ratchet wheel 31.

As shown in FIG. 4, the positioning ring 32 has a projection 322 axially extending from one side opposite to the wrench body 30 for a user to push inward. As shown in FIG. 3 and referring to FIGS. 5-6, the positioning ring 32 has an elastic member 33 disposed on the inner wall of the central bore 321 of the positioning ring 32 opposite to the protrusion 323, wherein the elastic member 33 is sandwiched in between the outer periphery of the cylindrical flange 313 of the ratchet wheel 31 and the inner wall of the central bore 321 of the positioning ring 32 so as to provide a resilient recovery force for the positioning ring 32. The positioning ring 32 has a recess 324 in the inner wall of the central bore 321 opposite to the protrusion 323 for partially accommodating the elastic member 33. When the user pushes the positioning ring 32 a distance along the radial direction and toward the at least one protrusion 323 relative to the ratchet wheel 31, the elastic member 33 is compressed, and the at least one protrusion 323 is completely retracted into the aperture 314. When releasing the positioning ring 32, the elastic member 33 pushes the positioning ring 32 back to its initial position.

Figure 7:
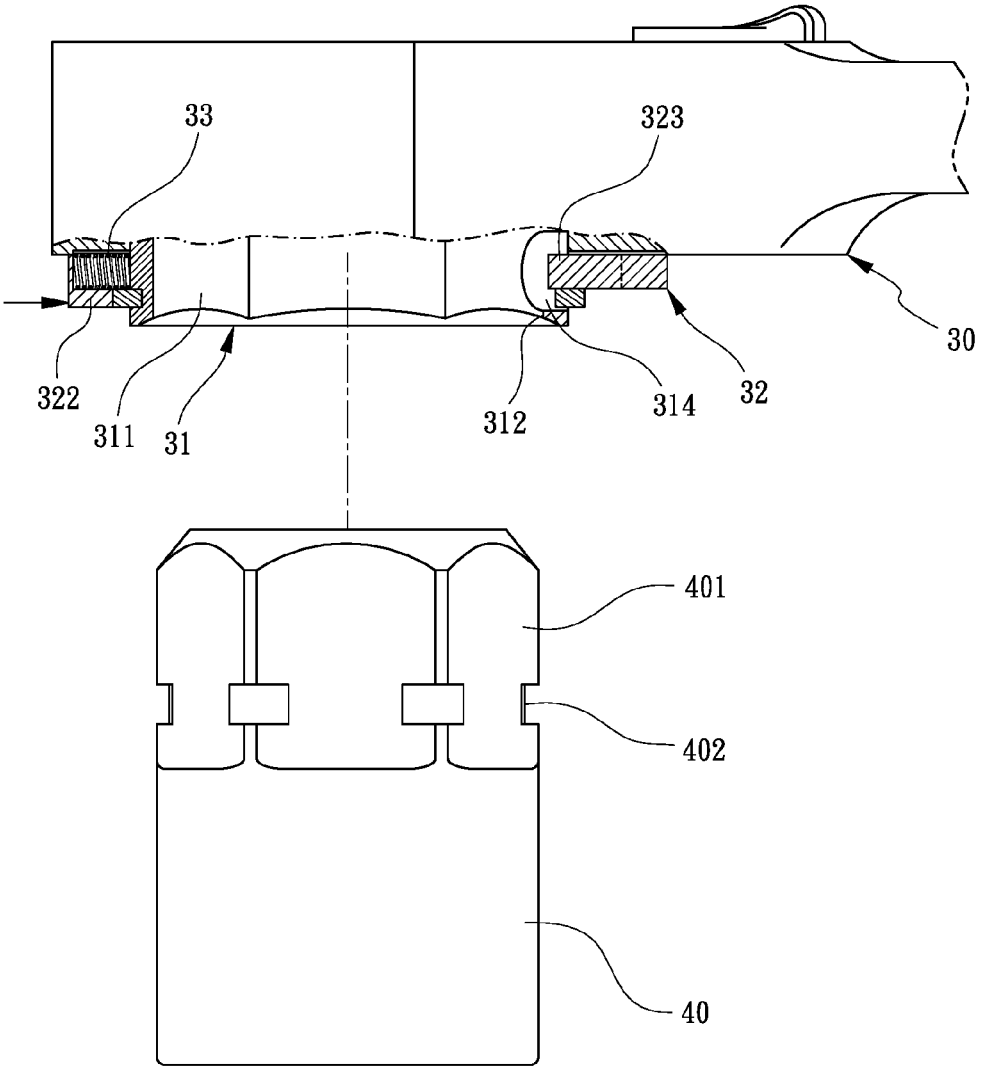
FIGS. 7-9 illustrate an operation of the socket wrench shown in FIG. 5.
Figure 8:
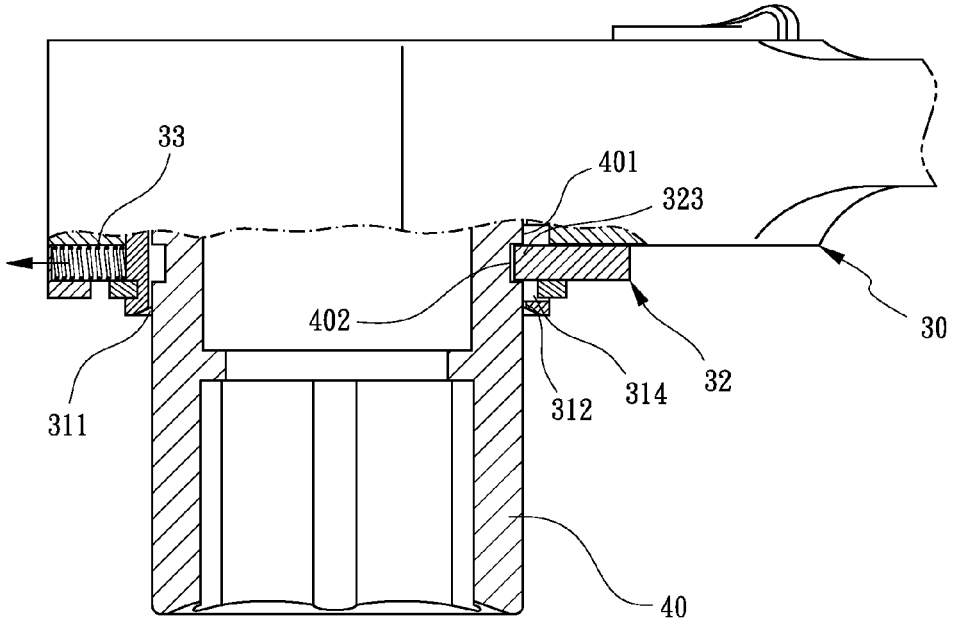
Figure 9:
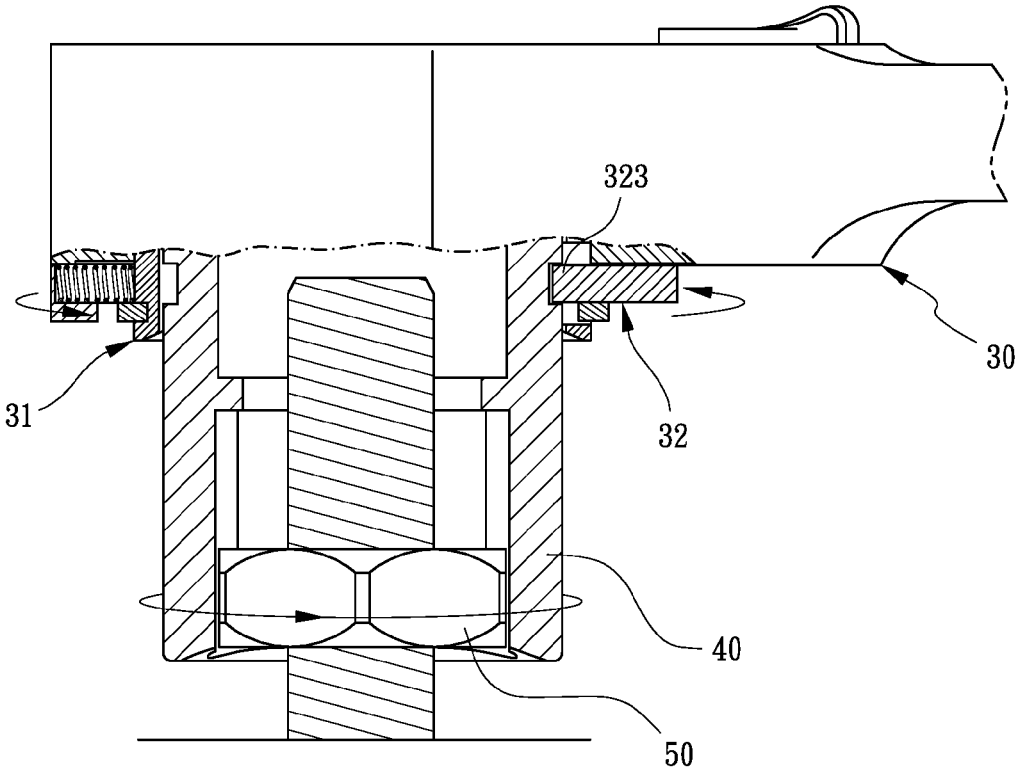

Referring to FIGS. 7-9, the socket wrench is applied to position a socket 40. The socket 40 has a polygonal post 401 and a plurality of notches 402 spaced in an outer periphery of the post 401. In operation, the protrusion 323 can be drawn back in the aperture 314 of the ratchet wheel 31 by pushing the positioning ring 32 inward as described above, so that the socket 40 can be inserted in the driving hole 311 of the ratchet wheel 31. While releasing the positioning ring 32, the protrusion 323 is positioned in the respective notch 402 via the resilient recovery force of the elastic member 33 so as to retain the socket 40 in the driving hole 311 of the ratchet wheel 31 and further to operate a bolt 50.

Figure 10:
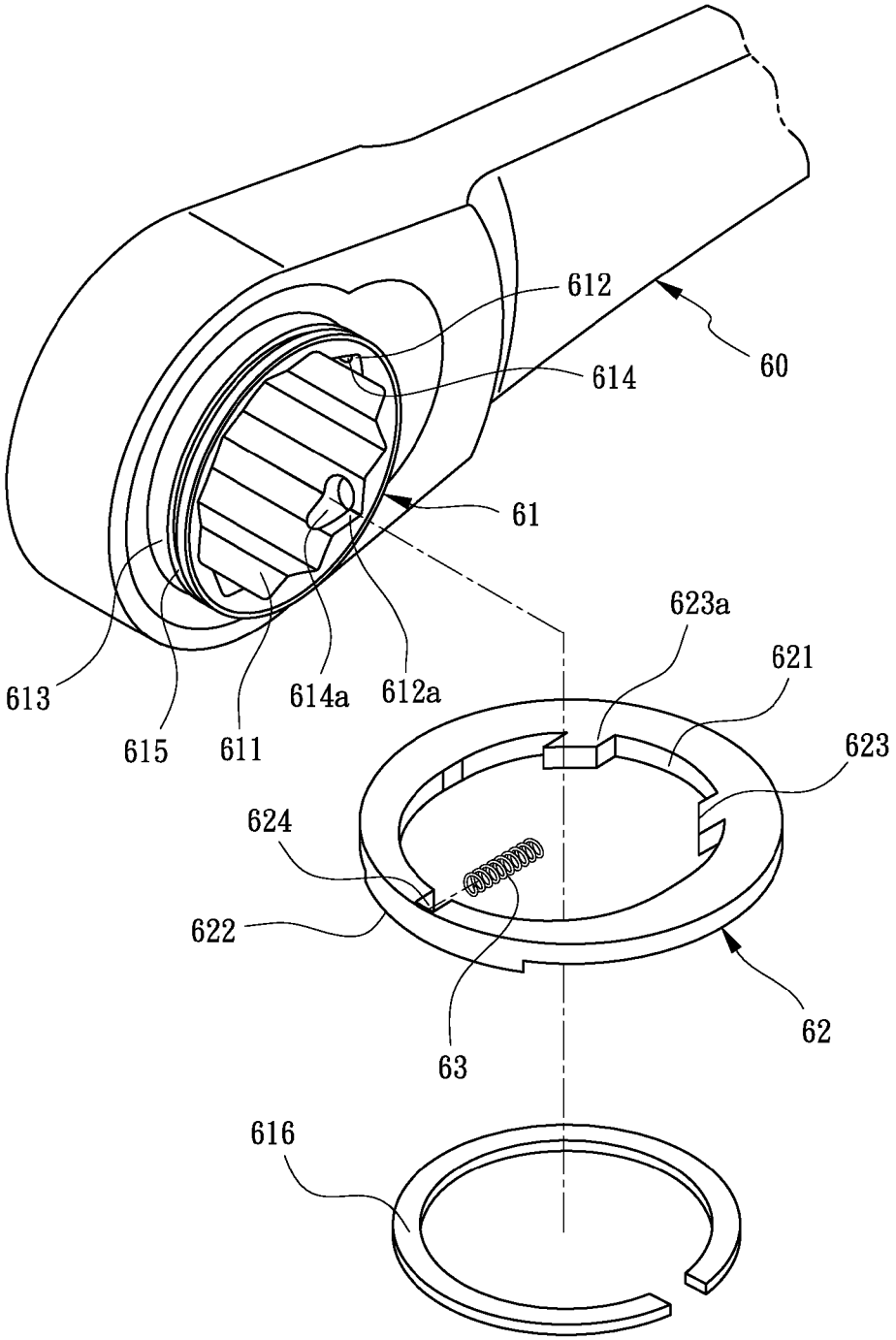
FIG. 10 is a partial exploded perspective view of a socket wrench in accordance with a second embodiment of the present invention.
Figure 11:
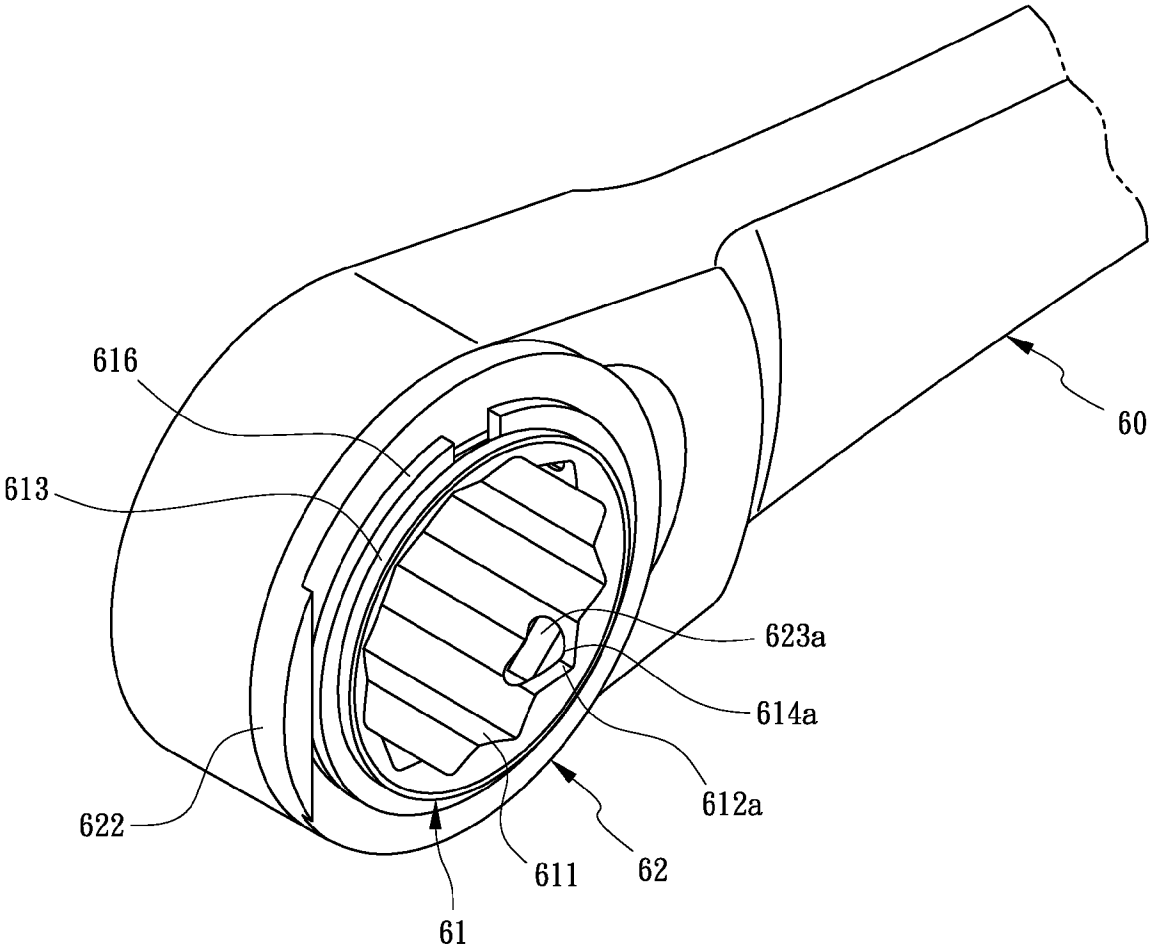
FIG. 11 is a perspective view of the socket wrench shown in FIG. 10.
Figure 12:
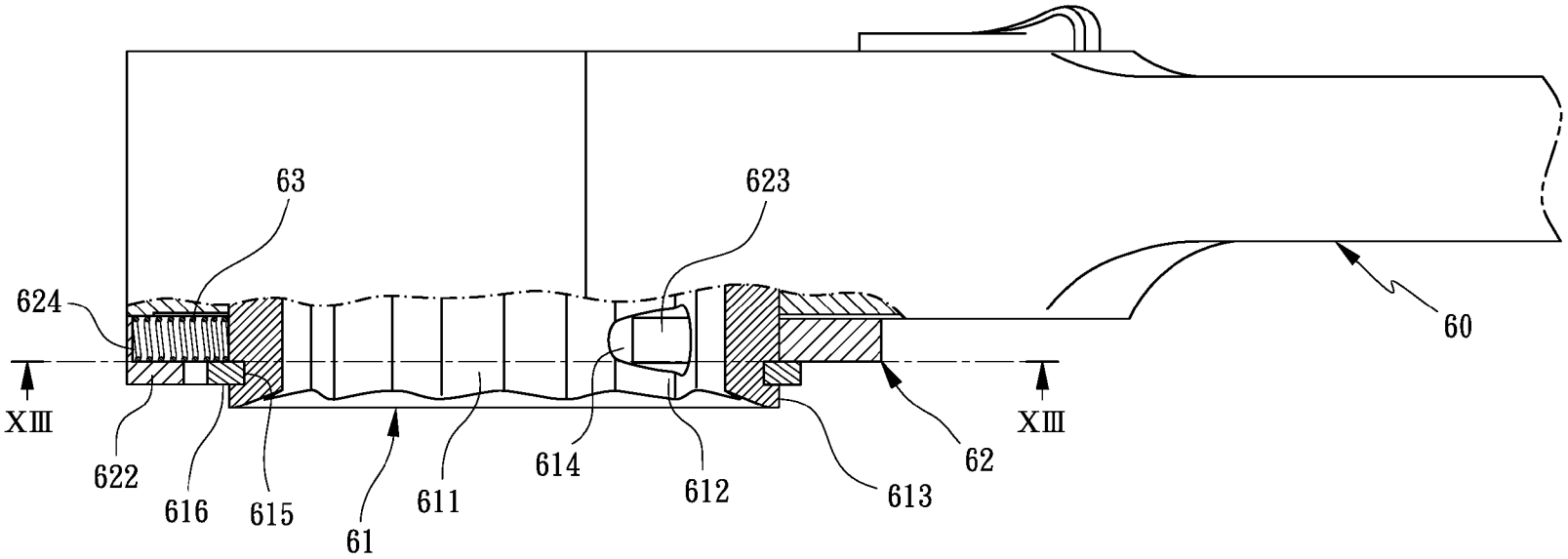
FIG. 12 is a partial cross-sectional view of the socket wrench shown in FIG. 11.
Figure 13:
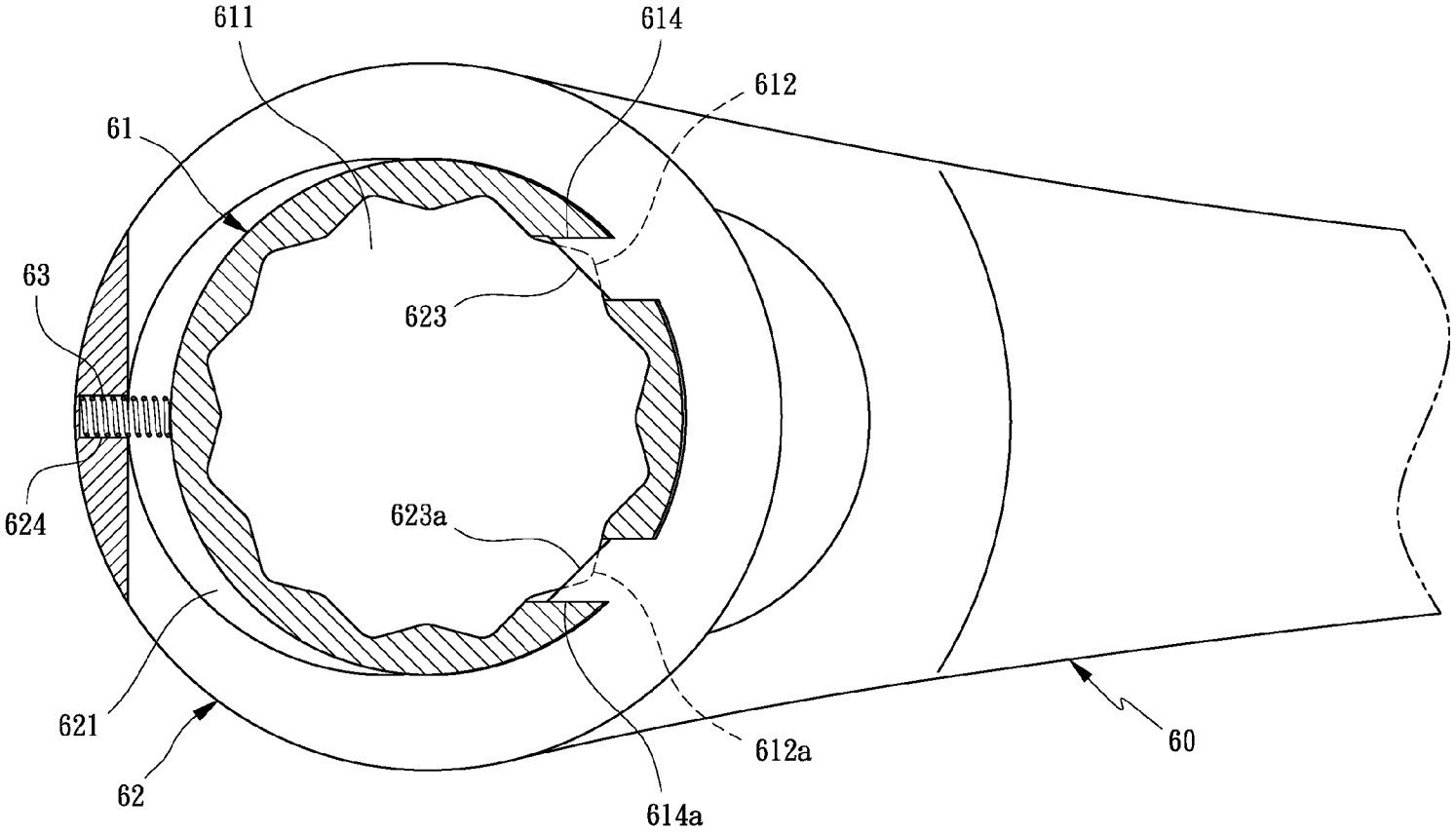
FIG. 13 is a cross-sectional view of the socket wrench along line XIII-XIII of FIG. 12.

Referring to FIGS. 10-13, a socket wrench in accordance with a second embodiment of the present invention comprises a wrench body 60, a ratchet wheel 61 and a positioning ring 62 which is an O-shaped ring. The ratchet wheel 61 is received in the wrench body 60. The ratchet wheel 61 has a driving hole 611 and a cylindrical flange 613 extending on one side of the wrench body 60. The driving hole 611 of the ratchet wheel 61 defines twelve equally spaced inner corners 612. The cylindrical flange 613 of the ratchet wheel 61 defines in the outer periphery thereof two apertures 614, 614*a* communicating with the driving hole 311 of the ratchet wheel 31. The two apertures 614, 614*a* are defined in two of the twelve inner corners 612 of the ratchet wheel 61. The positioning ring 62 is movably surrounded the cylindrical flange 613 of the ratchet wheel 61. Specifically, the positioning ring 62 has a central bore 621 and two parallel protrusions 623, 623*a* radially protruded from the inner wall of the central bore 621 of the positioning ring 62. The two protrusions 623, 623*a* are projected from the wall of the driving hole 611 respectively through the two apertures 614, 614*a* of the ratchet wheel 61, as shown in FIGS. 11-13.

Referring to FIGS. 10-11, the socket wrench of the second embodiment further comprises a C-ring 616. The cylindrical flange 613 of the ratchet wheel 61 has an annular groove 615 in the outer periphery thereof. The C-ring 616 is positioned in the retaining groove 615 to prevent the positioning ring 62 from dropping from the ratchet wheel 61. As shown in FIG. 11, the positioning ring 62 has a projection 622 axially extending from one side opposite to the wrench body 60.

As shown in FIG. 10 and FIGS. 12-13, the positioning ring 62 has an elastic member 63 disposed on the inner wall of the central bore 621 of the positioning ring 62 opposite to the two protrusions 623, 623*a*, wherein the elastic member 63 is sandwiched in between the outer periphery of the cylindrical flange 613 of the ratchet wheel 61 and the inner wall of the central bore 621 of the positioning ring 62 so as to provide a resilient recovery force for the positioning ring 62. The positioning ring 62 has a recess 624 in the inner wall of the central bore 621 for partially accommodating the elastic member 63.

Figure 14:
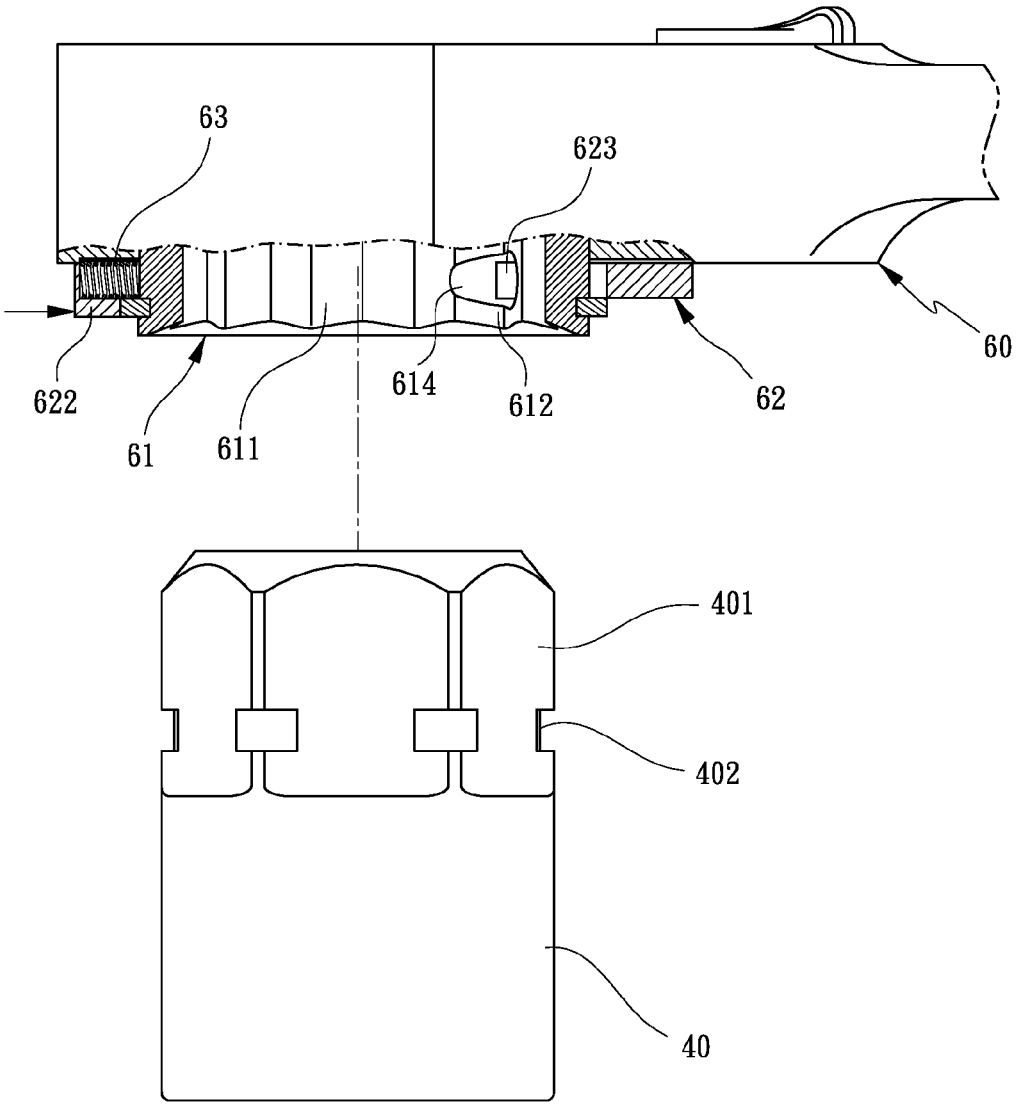
FIG. 14 illustrates an operation of the socket wrench shown in FIG. 12.
Figure 15:
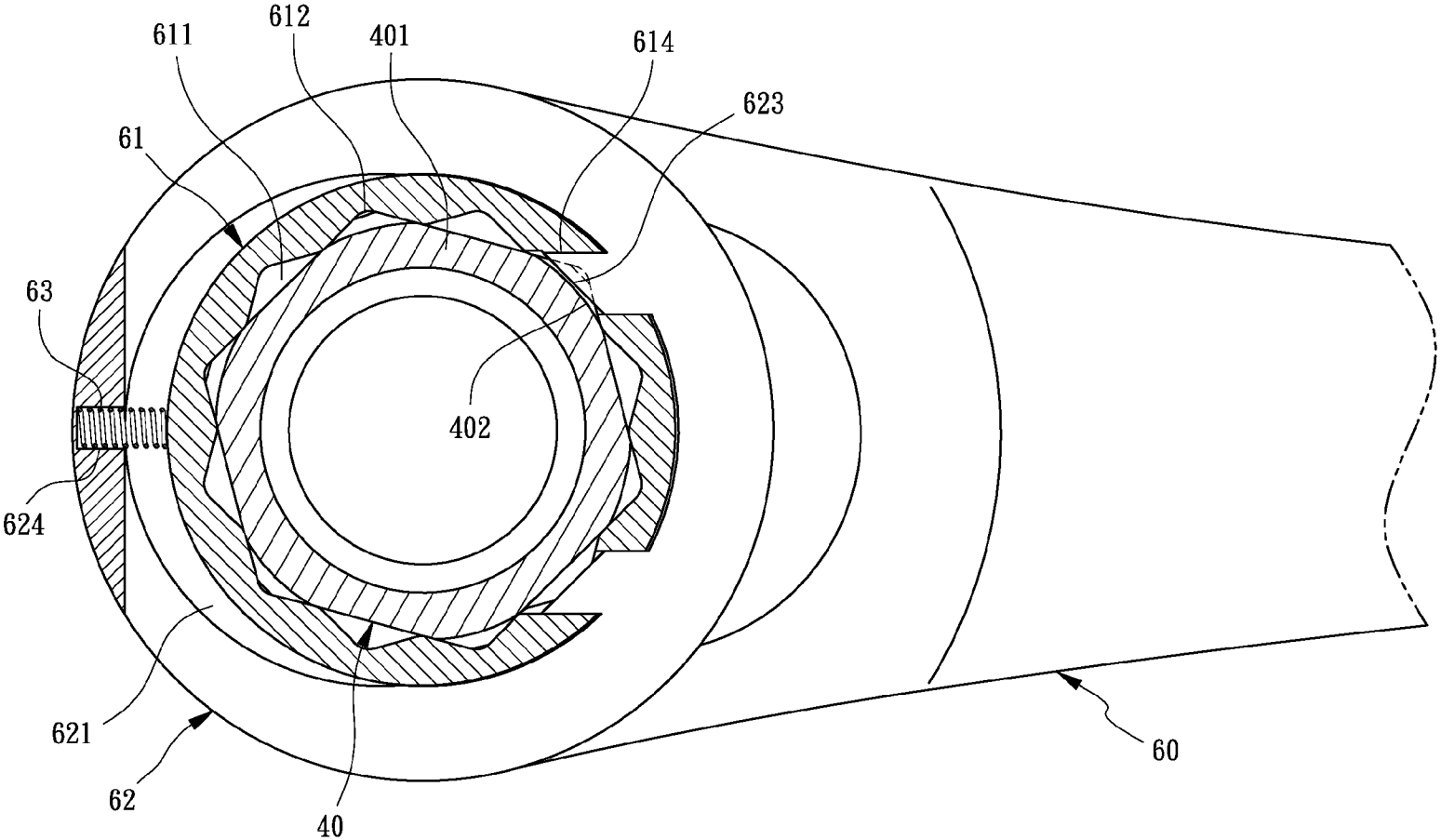
FIGS. 15-16 illustrate a socket positioned in a driving hole of a ratchet wheel.
Figure 16:
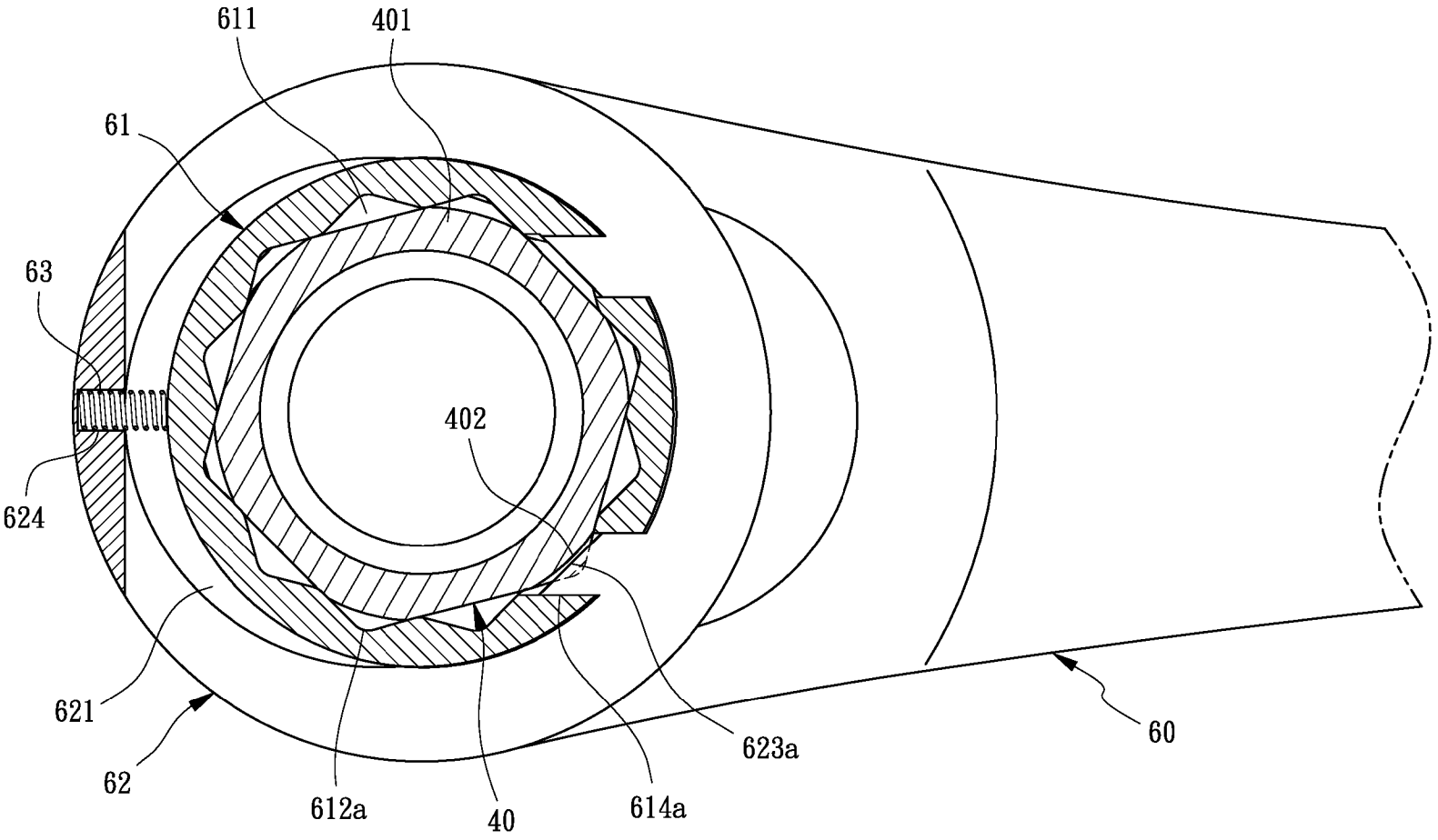

FIGS. 14-16 illustrate an operation of the socket wrench of the second embodiment which is similar to the first embodiment, except that the socket 40 can be positioned in the driving hole 611 of the ratchet wheel 61. Specifically the socket 40 can be selectively positioned in a first position where the socket 40 is restricted by one protrusion 623, as shown in FIG. 15, and a second position where the socket 40 is restricted by the other protrusion 623*a*, as shown in FIG. 16.

Figure 17:
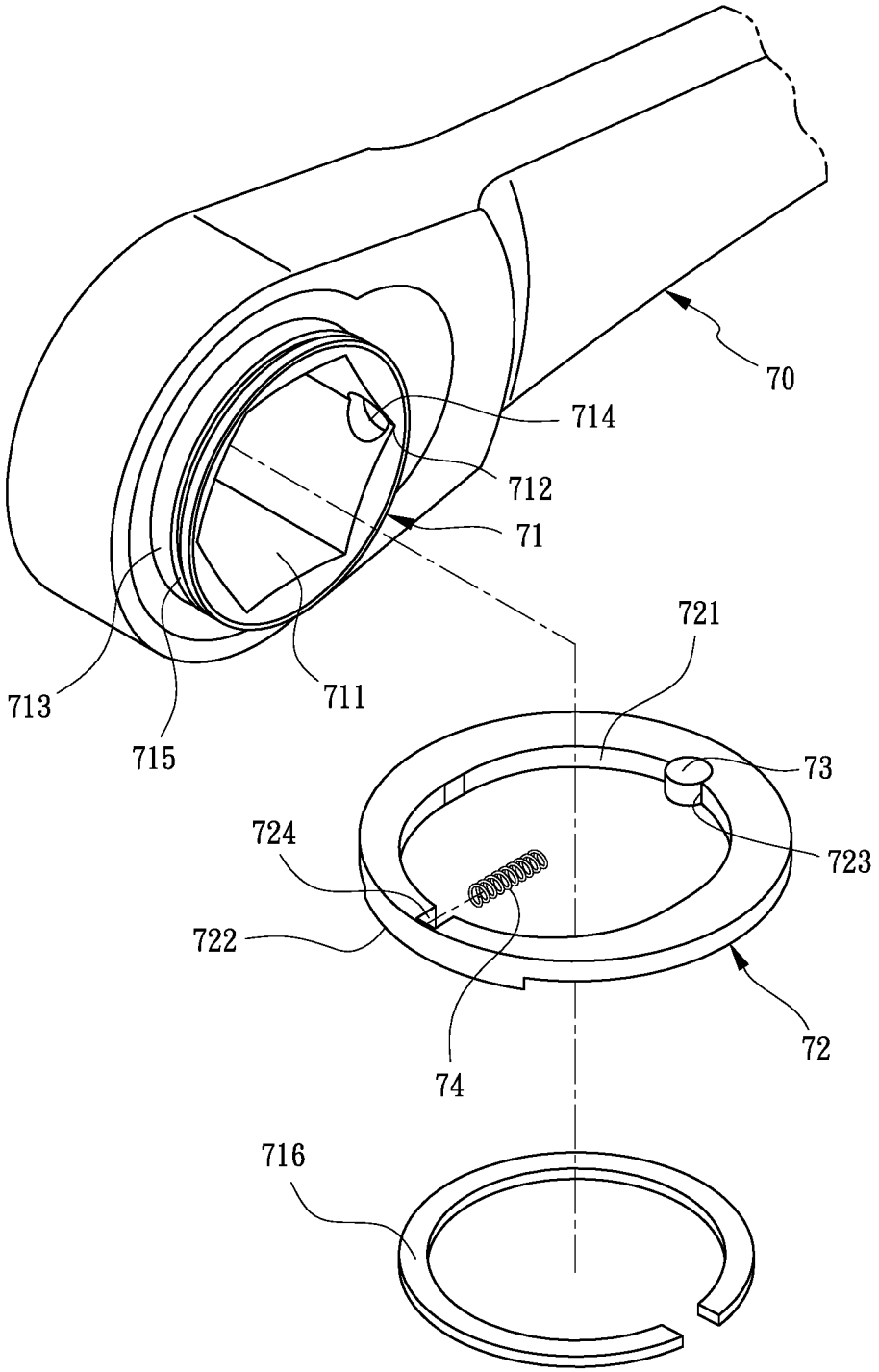
FIG. 17 is a partial exploded perspective view of a socket wrench in accordance with a third embodiment of the present invention.
Figure 18:
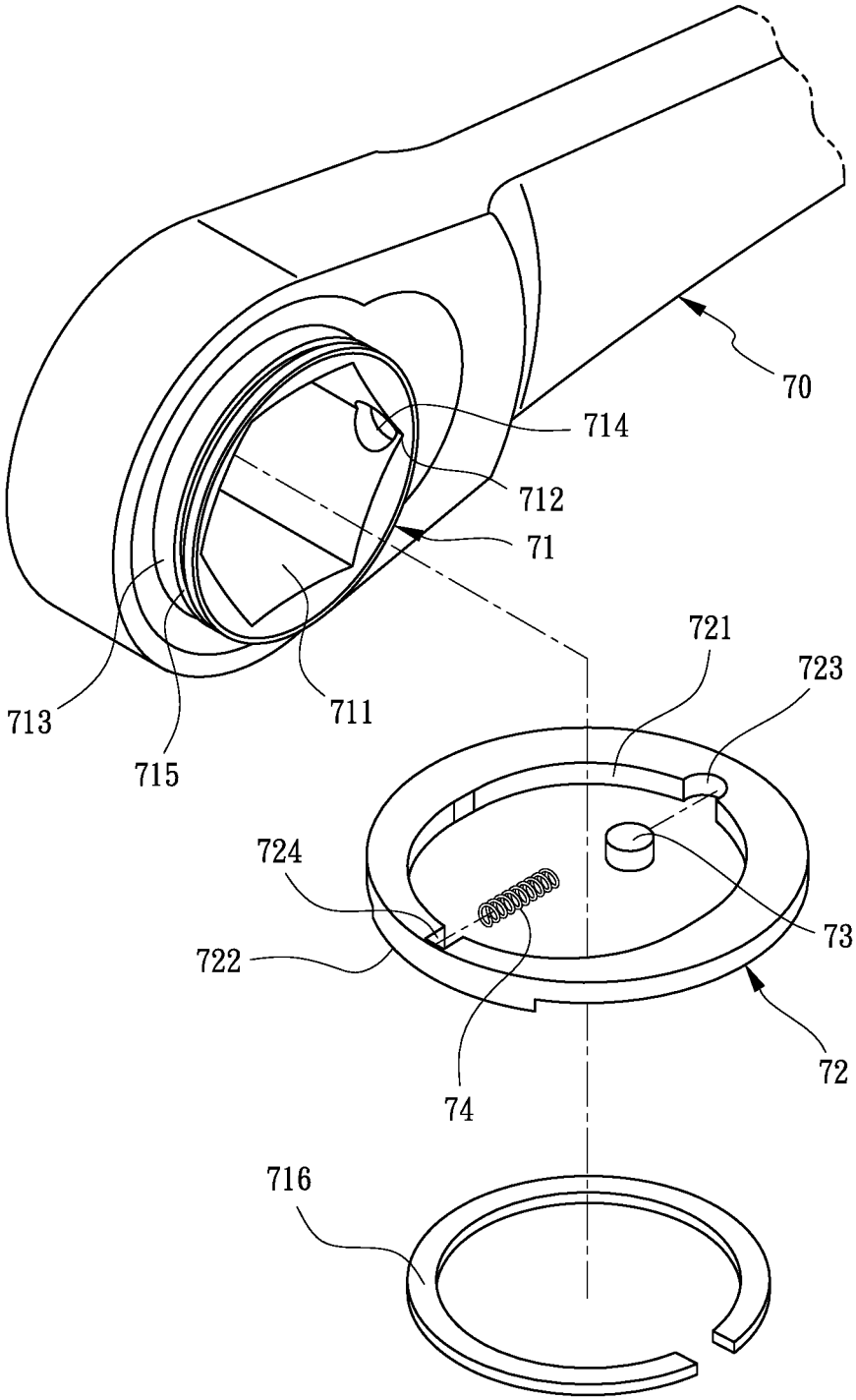
FIG. 18 is another partial exploded perspective view of a socket wrench shown in FIG. 7, wherein a retaining block is detached from a recess of a positioning ring.

Referring to FIGS. 17-18, a socket wrench in accordance with a third embodiment of the present invention comprises a wrench body 70, a ratchet wheel 71 and a positioning ring 72 which is an O-shaped ring. The ratchet wheel 71 is received in the wrench body 70. The ratchet wheel 71 has a driving hole 711 and a cylindrical flange 713 extending on one side of the wrench body 70. The cylindrical flange 713 of the ratchet wheel 71 defines in the outer periphery thereof an aperture 714 communicating with the driving hole 711 of the ratchet wheel 71. The positioning ring 72 is movably surrounded the cylindrical flange 713 of the ratchet wheel 71. The positioning ring 72 has a central bore 721 and a protrusion 73 radially protruded from the inner wall of the central bore 721 of the positioning ring 72. The protrusion 73 is projected from the wall of the driving hole 711 through the aperture 714 of the ratchet wheel 71.

More specifically, the protrusion 73 is detachable from the inner wall of the central bore 721 of the positioning ring 72. The positioning ring 72 has a receiving groove 723 in the inner wall of the central bore 721 of the positioning ring 72 for accommodating the protrusion 73.

In the third embodiment of the present invention, the driving hole 711 of the ratchet wheel 71 is hexagonal and defines a plurality of inner corners 712. The aperture 714 of the ratchet wheel 71 is defined in one of the inner corners 712 of the driving hole 711 of the ratchet wheel 71 so that the protrusion 73 can be projected from the respective corner 712. Referring to FIG. 17, the socket wrench of the third embodiment further comprises a C-ring 716. Furthermore, the cylindrical flange 713 of the ratchet wheel 71 has an annular groove 715 in the outer periphery thereof. The C-ring 716 is positioned in the retaining groove 715 to prevent the positioning ring 72 from dropping from the ratchet wheel 71.

As shown in FIG. 17, the positioning ring 72 has a projection 722 axially extending from one side opposite to the wrench body 70. Furthermore, the positioning ring 72 has an elastic member 74 disposed on the inner wall of the central bore 721 of the positioning ring 72 opposite to the protrusion 73, wherein the elastic member 74 is sandwiched in between the outer periphery of the cylindrical flange 713 of the ratchet wheel 71 and the inner wall of the central bore 721 of the positioning ring 72 so as to provide a resilient recovery force for the positioning ring 72. The positioning ring 72 has a recess 724 in the inner wall of the central bore 721 opposite to the protrusion 73 for accommodating the elastic member 74.

The positioning ring 32/62/72 of the present invention is an O-shaped ring and can be pushed and moved a distance along the radial direction and toward the at least one protrusion 323/623,623*a*/73 relative to the ratchet wheel 31/61/71 to completely retract the at least one protrusion 323/623,623*a*/73 into the aperture 314/614, 614*a*/714.

The O-shaped ring has better structural strength and is easily manufactured.

Although embodiments of this invention have been fully described with reference to the accompanying drawings, it is to be understood that various modifications can be made by those skilled in the art without departing from the scope of the invention as hereinafter claimed.

What is claimed is:

1. A socket wrench comprising:

a wrench body;

a ratchet wheel received in the wrench body, the ratchet wheel having a driving hole and a cylindrical flange extending from one side of the wrench body, the cylindrical flange of the ratchet wheel having an outer periphery thereof, and at least one aperture defined through the cylindrical flange and communicating with the driving hole; and a positioning ring being an O-shaped ring and movably surrounded the outer periphery of the cylindrical flange of the ratchet wheel, the positioning ring having a central bore and at least one protrusion extending radially from an inner wall of the central bore of the positioning ring, the at least one protrusion projected into the driving hole through the aperture of the ratchet wheel, the positioning ring being moved a distance along a radial direction relative to the ratchet wheel by being pushed toward the at least one protrusion to completely retract the at least one protrusion into the aperture.

2. The socket wrench as claimed in claim 1, wherein the driving hole of the ratchet wheel is hexagonal and defines a plurality of inner corners.

3. The socket wrench as claimed in claim 2, wherein the aperture of the ratchet wheel is defined in one of the inner corners of the driving hole of the ratchet wheel.

4. The socket wrench as claimed in claim 1 further comprising a C-ring; wherein the cylindrical flange of the ratchet wheel has an annular groove defined in the outer periphery thereof, and the C-ring is positioned in the retaining groove to prevent the positioning ring from dropping from the cylindrical flange.

5. The socket wrench as claimed in claim 1, wherein the positioning ring defines a projection extending axially from one side opposite to the wrench body.

6. The socket wrench as claimed in claim 1, wherein the positioning ring has an elastic member disposed on the inner wall of the central bore of the positioning ring opposite to the protrusion, and the elastic member is sandwiched in between the outer periphery of the cylindrical flange of the ratchet wheel and the inner wall of the central bore of the positioning ring.

7. The socket wrench as claimed in claim 6, wherein the positioning ring has a recess defined in the inner wall of the central bore opposite to the protrusion for accommodating the elastic member.

8. The socket wrench as claimed in claim 1, wherein the driving hole of the ratchet wheel defines twelve equally spaced inner corners.

9. The socket wrench as claimed in claim 8, wherein the ratchet wheel further has another aperture, the two apertures are defined in two of the twelve inner corners of the ratchet wheel.

10. The socket wrench as claimed in claim 9, wherein the positioning ring further has another protrusion, the two protrusions are projected from the wall of the driving hole through the apertures of the ratchet wheel.

11. The socket wrench as claimed in claim 1, wherein the protrusion is detachable from the inner wall of the central bore of the positioning ring.

12. The socket wrench as claimed in claim 11, wherein the positioning ring has a receiving groove in the inner wall of the central bore of the positioning ring for partially accommodating the protrusion.

* * * * *